US005652051A

United States Patent [19]

Shawver et al.

[11] Patent Number: 5,652,051

[45] Date of Patent: Jul. 29, 1997

[54] NONWOVEN FABRIC FROM POLYMERS CONTAINING PARTICULAR TYPES OF COPOLYMERS AND HAVING AN AESTHETICALLY PLEASING HAND

[75] Inventors: Susan Elaine Shawver, Roswell; Paul Windsor Estey, Cumming; Linda Ann Connor, Roswell, all of Ga.

[73] Assignee: Kimberly-Clark Worldwide, Inc., Irving, Tex.

[21] Appl. No.: 395,218

[22] Filed: Feb. 27, 1995

[51] Int. Cl.[6] ..... B32B 27/00

[52] U.S. Cl. ..... 442/362; 428/373; 428/374; 428/903; 604/358; 604/367; 442/329; 442/363; 442/364; 442/382; 442/383; 442/384; 442/394; 442/398; 442/400; 442/401

[58] Field of Search ..... 428/284, 286, 428/296, 297, 298, 299, 903, 300, 373, 374; 604/358, 367

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,763 | 3/1970 | Hartmann | 264/210 |
| 3,542,615 | 11/1970 | Dobo et al. | 156/81 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 3,855,046 | 12/1974 | Hansen et al. | 161/150 |
| 3,909,009 | 9/1975 | Cvetko et al. | 274/37 |
| 3,914,497 | 10/1975 | Kanehira et al. | 428/288 |
| 3,922,257 | 11/1975 | Blunt et al. | 260/88.2 |
| 4,340,563 | 7/1982 | Appel et al. | 264/518 |
| 4,663,220 | 5/1987 | Wisneski et al. | 428/221 |
| 4,668,566 | 5/1987 | Braun | 428/286 |
| 4,707,398 | 11/1987 | Boggs | 428/224 |
| 4,741,949 | 5/1988 | Morman et al. | 428/224 |
| 4,803,117 | 2/1989 | Dapont | 428/228 |
| 5,108,820 | 4/1992 | Kaneko et al. | 428/198 |
| 5,108,827 | 4/1992 | Gessner | 428/219 |
| 5,188,885 | 2/1993 | Timmons et al. | 428/198 |
| 5,204,174 | 4/1993 | Daponte et al. | 428/286 |
| 5,244,724 | 9/1993 | Antonacci et al. | 428/288 |
| 5,322,728 | 6/1994 | Davey et al. | 428/296 |
| 5,324,580 | 6/1994 | Allan et al. | 428/284 |
| 5,330,672 | 7/1994 | Langer et al. | 252/108 |
| 5,336,552 | 8/1994 | Strack et al. | 428/224 |
| 5,346,756 | 9/1994 | Ogale et al. | 428/288 |
| 5,369,858 | 12/1994 | Gilmore et al. | 28/104 |
| 5,380,574 | 1/1995 | Katoh et al. | 428/92 |
| 5,380,810 | 1/1995 | Lai et al. | 526/352 |
| 5,382,400 | 1/1995 | Pike et al. | 264/168 |
| 5,540,979 | 7/1996 | Yahiaoui et al. | 428/212 |

FOREIGN PATENT DOCUMENTS

| | | | |
|---|---|---|---|
| 0552013 | 7/1993 | European Pat. Off. | D01F 6/06 |
| 0674035 | 9/1995 | European Pat. Off. . | |
| 0693585 | 1/1996 | European Pat. Off. . | |
| 9428224 | 12/1994 | WIPO . | |
| 952678 | 10/1995 | WIPO . | |

OTHER PUBLICATIONS

Polymer Blends and Composites by John A. Manson and Leslie H. Sperling, Plenum Press, New York, Copyright 1976.
IBN-0-306-30831-2, pp. 273-277.

*Primary Examiner*—James J. Bell
*Attorney, Agent, or Firm*—James B. Robinson

[57] ABSTRACT

There is disclosed fibers and fabrics formed from a polymer which is a "hand enhancing" polymer. The "hand enhancing" polymer is a copolymer of polypropylene which contains ethylene, 1-butene, or 1-hexene or a terpolymer of propylene, ethylene and butene. If the polymer is an ethylene copolymer, the copolymer may be random or random and block and the ethylene must be present in an amount between greater than 5 and 7.5 weight percent of the copolymer. If the copolymer contains 1-butene, it must be present in an amount between 1 and 15.4 weight percent of the copolymer. If the copolymer contains 1-hexene, it must be present in an amount between 2 and 5 weight percent of the copolymer. If the polymer is a terpolymer of propylene, ethylene and butylene, the polypropylene is present in an amount between 90 and 98 weight percent, the ethylene is present in an amount between 1 and 6 weight percent and the butylene is present in an amount between 1 and 6 weight percent.

The fibers may additionally have a second polymer adjacent the first polymer in a sheath/core, islands-in-the-sea or side-by-side conjugate orientation.

17 Claims, No Drawings

NONWOVEN FABRIC FROM POLYMERS CONTAINING PARTICULAR TYPES OF COPOLYMERS AND HAVING AN AESTHETICALLY PLEASING HAND

BACKGROUND OF THE INVENTION

This invention relates generally to thermoplastic polymers which may be fiberized and made into nonwoven fabrics by a number of processes. The fibers and fabrics thus formed are useful in a variety of personal care products such as diapers, training pants, incontinence products, wipers and feminine hygiene items. These fabrics may also be used in medical applications such as a component of a gown or sterilization wrap, as outdoor fabrics such as a geotextile, equipment cover or awning.

The most common thermoplastics for these applications are polyolefins, particularly polypropylene. Other materials such as polyesters, polyetheresters, polyamides and polyurethanes are also used to form nonwoven fabrics. The nonwoven fabrics used in these applications are often in the form of laminates like spunbond/meltblown/spunbond (SMS) laminates. Further, such fabrics may be made from fibers which are conjugate fibers.

The strength of a nonwoven fabric is one of the most desired characteristics. Higher strength webs allow thinner layers of material to be used to give strength equivalent to a thicker layer, thereby giving the consumer of any product of which the web is a part, a cost, bulk and weight savings. It is perhaps equally desirable that such webs, especially when used in consumer products such as diapers or feminine hygiene products, have a very pleasing hand.

It is an object of this invention to provide a nonwoven fabric or web which is sufficiently strong and yet also has a very pleasing hand.

SUMMARY OF THE INVENTION

The objectives of this invention are realized by fibers and fabrics formed from a polymer which is a "hand enhancing" copolymer. The "hand enhancing" polymer is a propylene copolymer which contains ethylene, 1-butene, or 1-hexene or it is a terpolymer of propylene, ethylene, and 1-butene. If the polymer is an ethylene copolymer, the copolymer must be random or random and block and the ethylene must be present in an amount between greater than 5 and 7.5 weight percent of the copolymer. If the copolymer contains 1-butene, the 1-butene must be present in the copolymer in an amount between 1 and 15.4 weight percent. If the copolymer contains 1-hexene, the 1-hexene must be present in the copolymer in an amount between 2 and 5 weight percent. If the polymer is a terpolymer of propylene, ethylene and butylene, the polypropylene is present in an amount between 90 and 98 weight percent, the ethylene is present in an amount between 1 and 6 weight percent and the butylene is present in an amount between 1 and 6 weight percent.

The fibers may additionally have a second polymer adjacent the first polymer in a sheath/core, islands-in-the-sea or side-by-side conjugate orientation.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, meltspraying and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier. The diameter of a polypropylene fiber given in microns, for example, may be converted to denier by squaring, and multiplying the result by 0.00629, thus, a 15 micron polypropylene fiber has a denier of about 1.42 ($152\times 0.00629=1.415$).

As used herein the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. Nos. 3,502,763 and 3,909,009 to Levy, and U.S. Pat. No. 3,542,615 to Dobo et al. Spunbond fibers are generally continuous and have diameters larger than 7 microns, more particularly, between about 10 and 30 microns.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241. Meltblown fibers are microfibers which may be continuous or discontinuous and are generally smaller than 10 microns in diameter.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic and atactic symmetries.

As used herein, the term "machine direction" or MD means the length of a fabric in the direction in which it is produced. The term "cross machine direction" or CD means the width of fabric, i.e. a direction generally perpendicular to the MD.

As used herein the term "monocomponent" fiber refers to a fiber formed from one or more extruders using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils which start and end at random. Biconstituent fibers are sometimes also referred to as multiconstituent fibers. Fibers of this general type are discussed in, for example, U.S. Pat. No. 5,108,827 to Gessner. Conjugate and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "bonding window" means the range of temperature of the calender rolls used to bond the nonwoven fabric together, over which such bonding is successful. For polypropylene spunbond, this bonding window is typically from about 270° F. to about 310° F. (132° C. to 154° C.). Below about 270° F. the polypropylene is not hot enough to melt and bond and above about 310° F. the polypropylene will melt excessively and can stick to the calender rolls. Polyethylene has an even narrower bonding window.

As used herein, the term "barrier fabric" means a fabric which is relatively impermeable to the transmission of liquids, i.e., a fabric which has blood strikethrough rate of 1.0 or less according to ASTM test method 22.

As used herein, the term "garment" means any type of non-medically oriented apparel which may be worn. This includes industrial work wear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls, aprons and jackets, patient bedding, stretcher and bassinet sheets, and the like.

As used herein, the term "personal care product" means diapers, training pants, absorbent underpants, adult incontinence products, and feminine hygeine products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

As used herein, the term "outdoor fabric" means a fabric which is primarily, though not exclusively, used outdoors. Outdoor fabric includes fabric used in protective covers, camper/trailer fabric, tarpaulins, awnings, canopies, tents, agricultural fabrics and outdoor apparel such as head coverings, industrial work wear and coveralls, pants, shirts, jackets, gloves, socks, shoe coverings, and the like.

TEST METHODS

1. Cup Crush

The softness of a nonwoven fabric may be measured according to the "cup crush" test. The cup crush test evaluates fabric stiffness by measuring the peak load required for a 4.5 cm diameter hemispherically shaped foot to crush a 23 cm by 23 cm piece of fabric shaped into an approximately 6.5 cm diameter by 6.5 cm tall inverted cup while the cup shaped fabric is surrounded by an approximately 6.5 cm diameter cylinder to maintain a uniform deformation of the cup shaped fabric. The foot and the cup are aligned to avoid contact between the cup walls and the foot which could affect the peak load. The peak load is measured while the foot is descending at a rate of about 0.25 inches per second (38 cm per minute). A lower cup crush value indicates a softer laminate. A suitable device for measuring cup crush is a model FTD-G-500 load cell (500 gram range) available from the Schaevitz Company, Pennsauken, N.J. Cup crush is measured in grams.

2. Melt Flow Rate

The melt flow rate (MFR) is a measure of the viscosity of a polymers. The MFR is expressed as the weight of material which flows from a capillary of known dimensions under a specified load or shear rate for a measured period of time and is measured in grams/10 minutes at 230° C. according to, for example, ASTM test 1238, condition E.

3. Grab Tensile Test

The grab tensile test is a measure of breaking strength and elongation or strain of a fabric when subjected to unidirectional stress. This test is known in the art and conforms to the specifications of Method 5100 of the Federal Test Methods Standard No. 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for grab tensile strength and grab elongation are obtained using a specified width of fabric, usually 4 inches (102 mm), clamp width and a constant rate of extension. The sample is wider than the clamp to give results representative of effective strength of fibers in the clamped width combined with additional strength contributed by adjacent fibers in the fabric. The specimen is clamped in, for example, an Instron Model TM, available from the Instron Corporation, 2500 Washington St., Canton, Mass. 02021, or a Thwing-Albert Model INTELLECT II available from the Thwing-Albert Instrument Co., 10960 Dutton Rd., Phila., Pa. 19154, which have 3 inch (76 mm) long parallel clamps. This closely simulates fabric stress conditions in actual use.

DETAILED DESCRIPTION OF THE INVENTION

Spunbond nonwoven fabric is produced by a method known in the art and described in a number of the references cited. Briefly, the spunbond process generally uses a hopper which supplies polymer to a heated extruder. The extruder supplies melted polymer to a spinnerette where the polymer is fiberized as it passes through fine openings usually arranged in one or more rows in the spinnerette, forming a curtain of filaments. The filaments are usually quenched with air at a low pressure, drawn, usually pneumatically, and deposited on a moving foraminous mat, belt or "forming wire" to form the nonwoven fabric. Spunbond fabrics are generally produced with basis weights of between about 0.1 osy and about 3.5 osy (3 gsm and 119 gsm).

The fibers produced in the spunbond process are usually in the range of from about 10 to about 30 microns in diameter, depending on process conditions and the desired end use for the fabrics to be produced from such fibers. For example, increasing the polymer molecular weight or decreasing the processing temperature result in larger diameter fibers. Changes in the quench fluid temperature and pneumatic draw pressure can also affect fiber diameter.

After formation onto the forming wire, spunbond fabrics are generally bonded in some manner in order to give them sufficient integrity for further processing. Thermal point bonding is quite common and involves passing a fabric or web of fibers to be bonded between a heated calender roll and an anvil roll. The calender roll is usually patterned in some way so that the entire fabric is not bonded across its entire surface. As a result, various patterns for calender rolls have been developed for functional as well as aesthetic reasons. One example is the Hansen Pennings or "H&P" pattern with about a 30% bond area with about 100 bonds/square inch as taught in U.S. Pat. No. 3,855,046 to Hansen and Pennings. The H&P pattern has square pin bonding areas wherein each pin has a side dimension of 0.038 inches (0.965mm), a spacing of 0.070 inches (1.778mm) between pins, and a depth of bonding of 0.023 inches (0.584 mm). The resulting pattern has a bonded area of about 29.5%. Another typical bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As in well known in the art, the spot bonding holds the laminate layers together as well as imparts integrity to each individual layer by bonding filaments and/or fibers within each layer.

Polymers useful in the spunbond process generally have a process melt temperature of between about 350° F. to about 610° F. (175° C. to 320° C.) and a melt flow rate, as defined above, in the range of about 10 to about 150, more particularly between about 10 and 50. Examples of suitable polymers include polyolefins like polypropylene and polyethylene, polyamides and polyesters.

Conjugate fibers may also be produced in the practice of this invention wherein at least one of the components is a hand enhancing polymer of this invention. Conjugate fibers are commonly arranged in a sheath/core, "islands in the sea" or side by side configuration.

The polymers useful in the practice of this invention are a propylene copolymer with ethylene in which the ethylene is present in an amount between greater than 5 and 7.5 weight percent of the copolymer, a propylene copolymer containing 1-butene in which the 1-butene is present in an amount between 1 and 15.4 weight percent of the copolymer, a propylene copolymer containing 1-hexene in which the 1-hexene is present in an amount between 2 and 5 weight percent of the copolymer, and a terpolymer of propylene, ethylene and butylene in which the polypropylene is present in an amount between 90 and 98 weight percent, the ethylene is present in an amount between 1 and 6 weight percent and the butylene is present in an amount between 1 and 6 weight percent.

The spunbond fabric produced from the fibers of this invention may be laminated to other materials to form useful multilayer products. Examples of such laminates are SMS (spunbond, meltblown, spunbond) or SFS (spunbond, film, spunbond) constructions wherein at least one spunbond layer is produced in accordance with this invention. Such a laminated fabric may be made by first depositing onto a forming wire a layer of spunbond fibers. The intermediate layer of meltblown fibers or film is deposited on top of the spunbond fibers. Lastly, another layer of spunbond fibers is deposited atop the meltblown layer and this layer is usually preformed. There may be more than one intermediate layer.

Alternatively, all of the layers may be produced independently and brought together in a separate lamination step. The nonwoven meltblown fibers or the film used in an intermediate layer may be made from non-elastomeric polymers such as polypropylene and polyethylene or may be made from an elastomeric thermoplastic polymer.

Elastomeric thermoplastic polymer may be those made from styrenic block copolymers, polyurethanes, polyamides, copolyesters, ethylene vinyl acetates (EVA) and the like. Generally, any suitable elastomeric fiber or film forming resins or blends containing the same may be utilized to form the nonwoven webs of elastomeric fibers or elastomeric film.

Styrenic block copolymers include styrene/butadiene/styrene (SBS) block copolymers, styrene/isoprene/styrene (SIS) block copolymers, styrene/ethylene-propylene/styrene (SEPS) block copolymers, styrene/ethylene-butadiene/styrene (SEBS) block copolymers. For example, useful elastomeric fiber forming resins include block copolymers having the general formula A—B—A' or A—B, where A and A' are each a thermoplastic polymer endblock which contains a styrenic moiety such as a poly (vinyl arene) and where B is an elastomeric polymer midblock such as a conjugated diene or a lower alkene polymer. Block copolymers of the A—B—A' type can have different or the same thermoplastic block polymers for the A and A' blocks, and the present block copolymers are intended to embrace linear, branched and radial block copolymers. In this regard, the radial block copolymers may be designated $(A—B)_m—X$, wherein X is a polyfunctional atom or molecule and in which each $(A—B)_m—$ radiates from X in a way that A is an endblock. In the radial block copolymer, X may be an organic or inorganic polyfunctional atom or molecule and m is an integer having the same value as the functional group originally present in X. It is usually at least 3, and is frequently 4 or 5, but not limited thereto. Thus, in the present invention, the expression "block copolymer", and particularly "A—B—A'" and "A—B" block copolymer, is intended to embrace all block copolymers having such rubbery blocks and thermoplastic blocks as discussed above, which can be extruded (e.g., by meltblowing), and without limitation as to the number of blocks.

U.S. Pat. No. 4,663,220 to Wisneski et al. discloses a web including microfibers comprising at least about 10 weight percent of an A—B—A' block copolymer where "A" and "A'" are each a thermoplastic endblock which comprises a styrenic moiety and where "B" is an elastomeric poly (ethylene-butylene) midblock, and from greater than 0 weight percent up to about 90 weight percent of a polyolefin which when blended with the A—B—A' block copolymer and subjected to an effective combination of elevated temperature and elevated pressure conditions, is adapted to be extruded, in blended form with the A—B—A' block copolymer. Polyolefins useful in Wisneski et al. may be polyethylene, polypropylene, polybutene, ethylene copolymers, propylene copolymers, butene copolymers, and mixtures thereof. Commercial examples of such elastomeric copolymers are, for example, those known as KRATON® materials which are available from Shell Chemical Company of Houston, Texas. KRATON® block copolymers are available in several different formulations, a number of which are identified in U.S. Pat. No. 4,663,220, hereby incorporated by reference. A particularly suitable elastomeric layer may be formed from, for example, elastomeric poly(styrene/ethylene-butylene/styrene) block copolymer available from the Shell Chemical Company under the trade designation KRATON® G-1657.

Other exemplary elastomeric materials which may be used to form an elastomeric layer include polyurethane elastomeric materials such as, for example, those available under the trademark ESTANE® from B. F. Goodrich & Co., polyamide elastomeric materials such as, for example, those available under the trademark PEBAX® from the Rilsan Company, and polyester elastomeric materials such as, for example, those available under the trade designation HYTREL® from E. I. DuPont De Nemours & Company.

Formation of an elastomeric nonwoven web from polyester elastomeric materials is disclosed in, for example, U.S. Pat. No. 4,741,949 to Morman et al., hereby incorporated by reference. Commercial examples of copolyester materials are, for example, those known as ARNITEL®, formerly available from Akzo Plastics of Arnhem, Holland and now available from DSM of Sittard, Holland, or those known as HYTREL® which are available from E. I. dupont de Nemours of Wilmington, Del.

Elastomeric layers may also be formed from elastomeric copolymers of ethylene and at least one vinyl monomer such as, for example, vinyl acetates, unsaturated aliphatic monocarboxylic acids, and esters of such monocarboxylic acids. The elastomeric copolymers and formation of elastomeric nonwoven webs from those elastomeric copolymers are disclosed in, for example, U.S. Pat. No. 4,803,117.

Particularly useful elastomeric meltblown thermoplastic webs are composed of fibers of a material such as disclosed in U.S. Pat. No. 4,707,398 to Boggs, U.S. Pat. No. 4,741,949 to Morman et al., and U.S. Pat. No. 4,663,220 to Wisneski et al. In addition, the elastomeric meltblown thermoplastic polymer layer may itself be composed of thinner layers of elastomeric meltblown thermoplastic polymer which have been sequentially deposited one atop the other or laminated together by methods known to those skilled in the art, such as, for example thermal bonding, ultrasonic bonding, hydroentanglement, needlepunch bonding and adhesive bonding.

The fabric of this invention may be treated, either prior to or after lamination, with various chemicals in accordance with known techniques to give properties for specialized uses. Such treatments include water repellent chemicals, softening chemicals, fire retardant chemicals, oil repellent chemicals, antistatic agents and mixtures thereof. Pigments may also be added to the fabric as a post-bonding treatment or alternatively added to the polymer of the desired layer prior to fiberization.

Fabrics and laminates made according to this invention were tested for strength and hand. The units used in the Tables are, for cup crush total energy, gram/millimeter, for cup crush load, grams, for peak load, pounds, for peak energy, inch-pounds, and for fail elongation, inches.

Table 1 shows the results of spunbond fabric produced according to the method of U.S. Pat. No. 4,340,563 to Appel et al. and made according to this invention with a copolymer of propylene and 1-butene as the hand enhancing copolymer. In Table 1, all of the fabric was produced at a basis weight of about 0.7 osy (24 gsm) at a rate of 0.7 grams/hole/minute (ghm) and extruded through 0.6 mm holes. The melt temperature of the polymers and the bonding temperature of the fabrics are given in Table 1. The fabrics were bonded using thermal point calender bonding with a wire weave pattern. The polypropylene listed in Table 1 as PP Control was not a copolymer but was in both cases a commercially available polypropylene polymer from Shell Chemical Company known as grade E5E65 and having a melt flow rate at 230° C. of about 38. The samples are identified according to the weight percent of 1-butene in the copolymer. The 1 weight percent 1-butene copolymers had, in order, a melt flow rate of about 44 and 52. The 14 weight percent 1-butene copolymer had a melt flow rate of about 41. The 12.5 weight percent 1-butene copolymer had a melt flow rate of about 32. The 15.4 weight percent 1-butene copolymer had a melt flow rate of about 30. The data is unnormalized.

Table 2 shows the results of spunbond fabric produced according to the method of U.S. Pat. No. 4,340,563 to Appel et al. and made according to this invention with a copolymer of propylene and 1-hexene as the hand enhancing copolymer. In Table 2, all of the fabric was produced at a basis weight of about 0.7 osy (24 gsm) at a rate of 0.7 grams/hole/minute (ghm) and extruded through 0.6mm holes. The melt temperature of the polymers and the bonding temperature of the fabrics are given in Table 2. The fabrics were bonded using thermal point calender bonding with an expanded Hansen-Pennings pattern. The polypropylene listed in Table 2 as PP Control was not a copolymer but was Shell's E5E65. The samples are identified according to the weight percent of 1-hexene in the copolymer. The 2.5 weight percent 1-hexene copolymer had a melt flow rate of about 40. The 5 weight percent 1-hexene copolymer had a melt flow rate of about 38.

Table 3 shows the results of spunbond fabric produced according to the method of U.S. Pat. No. 4,340,563 to Appel et al. and made according to this invention with a random copolymer of ethylene and propylene as the hand enhancing copolymer. In Table 3, the first four samples represent fabric produced at a basis weight of about 0.7 osy (24 gsm) and the second four samples represent fabric produced at a basis weight of 1.0 osy (34 gsm). All were produced at a rate of 0.7 grams/hole/minute (ghm) and extruded through 0.6mmholes. The melt temperature of the polymers and the bonding temperature of the fabrics are given in Table 3. The fabrics were bonded using thermal point calender bonding with a wire weave pattern. The polypropylene listed in Table 3 as PP Control was not a copolymer but was Shell's E5E65. The samples are identified according to the weight percent of ethylene in the copolymer. The 3 weight percent ethylene propylene copolymer had a melt flow rate of about 35. The 5.5 weight percent ethylene propylene copolymer had a melt flow rate of about 34 and is commercially available from the Shell Chemical Co. under the designation WRD6-277. The 7.5 weight percent ethylene propylene copolymer had a melt flow rate of about 40.

Table 4 shows the results of spunbond fabric produced according to the method of U.S. Pat. No. 4,340,563 to Appel et al. and made according to this invention with a terpolymer of propylene, ethylene and butene as the hand enhancing copolymer. All of the fabric in Table 4 was produced at a basis weight of about 1.0 osy (34 gsm) at a rate of 0.7 grams/hole/minute (ghm) and extruded through 0.6mm holes. The melt temperature of the polymers and the bonding temperature of the fabrics are given in Table 4. The fabrics were bonded using thermal point calender bonding with an expanded Hansen-Pennings pattern. The polypropylene listed in Table 4 as PP Control was not a copolymer but was a polypropylene homopolymer commercially available from the Exxon Chemical Company of Baytown, Tex. as ESCORENE® 3445 polypropylene. The samples are identified according to the weight percent of propylene/ethylene/butene, respectively, in the terpolymer. The 96/2/2 terpolymer had a melt flow rate of about 40. The 94/4/2 terpolymer had a melt flow rate of about 37. The 94/2/4 terpolymer had a melt flow rate of about 42. The 92/4/4 terpolymer had a melt flow rate of about 40.

The Tables show that spunbond webs made with the hand enhancing copolymers of the invention exhibit strikingly superior cup crush values, indicating a significantly softer web. In fact, the inventors have found that the fabrics made with fibers of this invention have cup crush energy values which are at least 25 percent less than a fabric made without the polymers meeting the requirements set forth herein. This improvement in cup crush is accomplished without significant deterioration of the strength of the fabric as indicated by the peak load, peak energy and fail elongation results.

TABLE 1

Propylene/1-Butene Copolymers (Unnormalized Data), % 1-butene

| | Cup Crush | | Peak Load | | Peak Energy | | Fail Elongation | | Melt Temp. | Bond Temp. |
|---|---|---|---|---|---|---|---|---|---|---|
| Sample | Tot. Energy | Load | MD | CD | MD | CD | MD | CD | (F.) | (F.) |
| PP Control | 1371.4 | 71.6 | 10.9 | 13.0 | 9.7 | 14.0 | 2.6 | 3.4 | 450 | 280 |
| Std. Dev | | | 1.6 | 0.6 | 3.6 | 1.6 | 0.4 | 0.3 | | |
| 1% | 1294.4 | 65.4 | 13.0 | 11.2 | 13.1 | 13.4 | 3.3 | 3.2 | 410 | 276 |
| Std. Dev | 110.7 | 5.0 | 1.6 | 1.5 | 3.0 | 3.1 | 0.4 | 0.5 | | |
| 1% | 1307.2 | 65.0 | 12.1 | 10.7 | 13.9 | 10.9 | 3.8 | 3.2 | 410 | 270 |
| Std. Dev | 137.7 | 1.2 | 0.6 | 1.5 | 1.6 | 2.9 | 0.4 | 0.4 | | |
| 14% | 822.4 | 41.8 | 12.2 | 8.2 | 14.3 | 8.6 | 3.8 | 3.3 | 410 | 220 |
| Std. Dev | 61.3 | 4.6 | 0.9 | 1.4 | 3.0 | 1.9 | 0.6 | 0.5 | | |
| PP Control | 1462.0 | 72.6 | 16.3 | 11.4 | 17.0 | 12.2 | 3.3 | 2.6 | 450 | 286 |
| Std. Dev | 2225.5 | 7.0 | 0.9 | 1.7 | 2.5 | 4.5 | 0.4 | 0.1 | | |
| 12.4% | 881.8 | 47.8 | 11.6 | 9.0 | 13.7 | 12.0 | 4.1 | 3.9 | 415 | 213 |
| Std. Dev | 83.6 | 9.3 | 1.5 | 0.5 | 2.3 | 3.7 | 0.2 | 0.6 | | |
| 15.4% | 682.4 | 37.4 | 12.0 | 9.2 | 11.9 | 10.6 | 3.5 | 3.5 | 415 | 214 |
| Std. Dev | 27.4 | 2.3 | 0.9 | 1.3 | 1.5 | 3.2 | 0.2 | 0.3 | | |

TABLE 2

Propylene/1 - Hexene Copolymers (Unnormalized Data), % C6

| | Cup Crush | | Peak Load | | Peak Energy | | Fail Elongation | | Melt Temp. | Bond Temp. |
|---|---|---|---|---|---|---|---|---|---|---|
| Sample | Tot. Energy | Load | MD | CD | MD | CD | MD | CD | (F.) | (F.) |
| PP Control | 1174.6 | 65.8 | 16.0 | 12.2 | 18.9 | 15.1 | 3.8 | 3.0 | 430 | 285 |
| Std. Dev. | 234.1 | 9.0 | 0.8 | 0.9 | 2.8 | 3.1 | 0.3 | 0.5 | | |
| 2.5% | 817.2 | 45.2 | 16.1 | 11.6 | 18.3 | 13.9 | 3.9 | 3.4 | 430 | 260 |
| Std. Dev. | 131.6 | 5.1 | 1.2 | 2.1 | 3.6 | 4.9 | 0.4 | 0.4 | | |
| 5% | 501.0 | 28.8 | 13.0 | 8.5 | 15.0 | 11.0 | 3.9 | 3.6 | 430 | 240 |
| Std. Dev. | 52.9 | 3.8 | 0.9 | 0.9 | 1.8 | 3.5 | 0.5 | 0.3 | | |

TABLE 3

Random copolymers of ethylene & propylene, % ethylene

| | Cup Crush | | Peak Load | | Peak Energy | | Fail Elongation | | Melt Temp. | Bond Temp. |
|---|---|---|---|---|---|---|---|---|---|---|
| Sample | Tot. Energy | Load | MD | CD | MD | CD | MD | CD | (F.) | (F.) |
| PP Control | 2095.2 | 105.6 | 16.6 | 11.4 | 14.9 | 9.8 | 2.6 | 3.2 | 430 | 285 |
| Std. Dev | 76.581 | 3.9 | 1.7 | 1.7 | 2.8 | 2.5 | 0.4 | 0.3 | 430 | 285 |
| 3% | 1273.2 | 59.6 | 14.6 | 11.0 | 10.3 | 9.3 | 3.4 | 2.9 | 430 | 270 |
| Std. Dev | 144.581 | 7.4 | 1.8 | 1.0 | 2.8 | 1.7 | 0.5 | 0.3 | | |
| 5.5% | 623.6 | 34.8 | 12.2 | 6.5 | 10.0 | 7.0 | 3.6 | 3.6 | 430 | 240 |
| Std. Dev | 86.6 | 6.6 | 1.1 | 0.5 | 2.4 | 1.7 | 0.2 | 0.2 | | |
| 7.5% | 310.8 | 16.8 | 8.3 | 5.1 | 7.5 | 7.5 | 4.1 | 4.6 | 430 | 223 |
| Std. Dev | 22.6 | 0.8 | 0.2 | 0.6 | 0.9 | 1.6 | 0.4 | 1.2 | | |
| PP Control | 3785.8 | 202.4 | 21.4 | 14.3 | 16.9 | 11.3 | 3.0 | 3.0 | 430 | 285 |
| Std. Dev | 531.8 | 17.2 | 2.0 | 2.0 | 3.7 | 3.8 | 0.2 | 0.5 | | |
| 3% | 2462.8 | 113.8 | 19.4 | 12.9 | 14.6 | 13.2 | 3.8 | 4.5 | 430 | 270 |
| Std. Dev | 83.4 | 6.5 | 1.4 | 1.6 | 2.1 | 1.5 | 0.3 | 0.5 | | |
| 5.5% | 1222.4 | 67.0 | 18.5 | 10.4 | 17.2 | 11.2 | 3.7 | 3.9 | 430 | 240 |
| Std. Dev | 72.8 | 6.2 | 1.4 | 1.0 | 3.1 | 4.0 | 0.4 | 0.3 | | |
| 7.5% | 664.8 | 36.8 | 12.0 | 7.7 | 11.2 | 9.6 | 4.0 | 3.9 | 430 | 223 |
| Std. Dev | 52.2 | 4.1 | 0.3 | 2.0 | 0.9 | 3.9 | 0.5 | 0.3 | | |

TABLE 4

Terpolymer, % C3=/C2=/C4=

| | Cup Crush | | Peak Load | | Peak Energy | | Fail Elongation | | Melt Temp. | Bond Temp. |
|---|---|---|---|---|---|---|---|---|---|---|
| Sample | Tot. Energy | Load | MD | CD | MD | CD | MD | CD | (F.) | (F.) |
| PP Control | 1309.8 | 71.6 | 17.4 | 9.8 | 17.8 | 10.8 | 4.4 | 3.6 | 450 | 285 |
| Std. Dev | 71.7 | 4.9 | 0.5 | 0.8 | 1.5 | 1.5 | 0.3 | 0.2 | | |
| 96/2/2 | 952.8 | 53.6 | 14.3 | 12.1 | 19.3 | 16.7 | 5.2 | 4.3 | 430 | 257 |
| Std. Dev | 40.9 | 6.1 | 0.6 | 1.0 | 3.0 | 2.4 | 0.5 | 0.5 | | |
| 94/4/2 | 389.8 | 22.0 | 10.7 | 8.2 | 15.3 | 14.1 | 5.6 | 5.4 | 430 | 244 |
| Std. Dev | 41.4 | 2.2 | 1.3 | 1.1 | 4.6 | 4.0 | 0.4 | 0.5 | | |
| PP Control | 1557.0 | 84.0 | 18.1 | 13.0 | 19.8 | 16.1 | 4.0 | 4.3 | 450 | 285 |
| Std. Dev | 144.1 | 7.3 | 0.7 | 1.2 | 2.0 | 3.0 | 0.2 | 0.4 | | |
| 94/2/4 | 801.8 | 43.6 | 14.4 | 11.5 | 21.8 | 19.5 | 5.3 | 5.1 | 430 | 244 |
| Std. Dev | 60.1 | 7.1 | 0.7 | 0.3 | 2.6 | 2.4 | 0.3 | 0.6 | | |
| 92/4/4 | 284.6 | 16.4 | 8.2 | 6.3 | 15.0 | 10.7 | 5.8 | 5.6 | 430 | 234 |
| Std. Dev | 10.7 | 1.5 | 0.9 | 0.9 | 2.9 | 3.2 | 0.5 | 0.7 | | |

What is claimed is:

1. A nonwoven fabric comprised of thermoplastic polymeric fibers comprising a hand enhancing first polymer selected from the group consisting of:

a copolymer of propylene and ethylene wherein said ethylene is present in an amount between greater than 5, and 7.5 weight percent of the copolymer, a copolymer of propylene and 1-butene wherein said 1-butene is present in an amount between 1 and 15.4 weight percent of the copolymer, and a copolymer of propylene and 1-hexene wherein said 1-hexene is present in an amount between 2 and 5 weight percent of the copolymer, wherein said fabric has a cup crush energy value at least 25 percent less than a similar fabric made without said hand enhancing polymer, and wherein said fabric is produced from a method selected from the group consisting of spunbonding, meltblowing and melt-spraying.

2. A nonwoven laminate comprising the fabric of claim 1 as a first layer wherein said fabric is a spunbond fabric, and a second layer of a spunbond polypropylene.

3. The nonwoven laminate of claim 2 wherein said nonwoven spunbond layers have between them at least one layer of an intermediate material selected from the group consisting of meltblown nonwoven fabric and film.

4. The fabric of claim 1 wherein said thermoplastic polymer fibers further comprise a second polymer as a separate phase adjacent said first polymer resulting in a conjugate fiber.

5. The fabric of claim 4 wherein said first and second polymers are arranged in a conjugate orientation selected from the group consisting of sheath/core, island-in-the-sea and side-by-side.

6. A nonwoven fabric comprised of the fiber of claim 5 and which has a basis weight between about 0.3 osy and about 3.5 osy.

7. The fabric of claim 6 wherein said method is spunbonding.

8. A nonwoven laminate comprising the fabric of claim 7 as a first layer wherein said fabric is a spunbond fabric, and a second layer of a spunbond polypropylene.

9. The nonwoven laminate of claim 8 wherein said nonwoven spunbond layers have between them at least one layer of an intermediate material selected from the group consisting of meltblown nonwoven fabric and film.

10. The nonwoven laminate of claim 9 wherein said intermediate material is a meltblown nonwoven fabric which is elastomeric and is made from a material selected from the group consisting of styrenic block copolymers, polyolefins, polyurethanes, polyesters, polyetheresters, and polyamides.

11. The nonwoven laminate of claim 9 wherein said intermediate material is a film which is elastomeric and is made from a film forming polymer selected from the group consisting of styrenic block copolymers, polyolefins, polyurethanes, polyesters, polyetheresters, and polyamides.

12. The nonwoven laminate of claim 9 wherein said layers are bonded together by a method selected from the group consisting of thermal bonding, ultrasonic bonding, hydroentanglement, needlepunch bonding and adhesive bonding.

13. The laminate of claim 12 which is present in a product selected from the group consisting of infection control products, personal care products and outdoor fabrics.

14. The laminate of claim 12 wherein said product is a personal care product and said personal care product is a diaper.

15. The laminate of claim 12 wherein said product is a personal care product and said personal care product is a feminine hygiene product.

16. The laminate of claim 12 wherein said product is a personal care product and said personal care product is an adult incontinence product.

17. The laminate of claim 12 wherein said product is a personal care product and said personal care product is a training pant.

* * * * *

UNITED STATES PATENT AND TRADEMARK OFFICE

CERTIFICATE OF CORRECTION

PATENT NO. : 5,652,051

DATED : July 29, 1997

INVENTOR(S) : Shawver et al.

It is certified that error appears in the above-identified patent and that said Letters Patent is hereby corrected as shown below:

Column 5, line 60, "in" should read -- is --

Column 4, line 39, "polymers" should read -- polymer --

Column 6, line 8, "islands in the sea" should read -- islands-in-the-sea --

Column 6, line 9, "side by side" should read -- side-by-side --

TABLE 3, line 10, "0.3 430 285" should read -- 0.3 --

Signed and Sealed this

Tenth Day of February, 1998

*Attest:*

Bruce Lehman

BRUCE LEHMAN

*Attesting Officer*

*Commissioner of Patents and Trademarks*